United States Patent [19]

Yamauchi et al.

[11] Patent Number: 4,942,384

[45] Date of Patent: Jul. 17, 1990

[54] COMPOSITE TYPE CRIME PREVENTIVE SENSOR

[75] Inventors: Kazumasa Yamauchi, Suita; Susumu Katayama, Hirakata, both of Japan

[73] Assignee: Matsushita Electric Works, Ltd., Osaka, Japan

[21] Appl. No.: 331,367

[22] Filed: Mar. 31, 1989

[30] Foreign Application Priority Data

Apr. 8, 1988 [JP] Japan ..... 63-87644
May 26, 1988 [JP] Japan ..... 63-128652

[51] Int. Cl.[5] ..... G08B 13/00

[52] U.S. Cl. ..... 340/522; 340/541; 340/567

[58] Field of Search ..... 340/541, 567, 554, 522, 340/508; 342/27-28; 367/93-94

[56] References Cited

U.S. PATENT DOCUMENTS 3,725,888 4/1973 Solomon ..... 340/522
4,052,720 10/1977 McGregor et al. ..... 340/522
4,103,293 7/1978 La Forge, Jr. ..... 340/522 X
4,401,976 8/1983 Stadelmayr ..... 340/522
4,630,246 12/1986 Fogler ..... 340/522 X
4,660,024 4/1987 McMaster ..... 340/522
4,710,750 12/1987 Johnson ..... 340/522
4,728,935 3/1988 Pantus et al. ..... 340/522 X
4,857,912 8/1989 Everett, Jr. et al. ..... 340/522 X

*Primary Examiner*—Joseph A. Orsino
*Assistant Examiner*—Thomas J. Mullen, Jr.
*Attorney, Agent, or Firm*—Burns, Doane, Swecker & Mathis

[57] ABSTRACT

A composite type crime preventive sensor processes output detection signals from a plurality of sensor units of mutually different detection systems for ranking the signals into a plurality of grades depending on signal level, and provides an intruder detection signal when a sum of ranked level values is above a preset reference value, whereby any risk of alarm failing and erroneous alarming can be effectively minimized.

7 Claims, 5 Drawing Sheets

COMPOSITE TYPE CRIME PREVENTIVE SENSOR

TECHNICAL BACKGROUND OF THE INVENTION

This invention relates to a composite type crime preventive sensor employing a plurality of sensor units of different detecting systems for detecting any intruder into a monitored zone.

DISCLOSURE OF PRIOR ART

As the crime preventive sensor, in general, there have been suggested various types of sensors of Doppler-effect system employing ultrasonic waves, microwaves and the like, infrared detection system utilizing a pyroelectric element, and so on. In these known sensors, however, there have been involved such problems that the Doppler-effect system of the ultrasonic waves is likely to be affected by the wind or the like air stream and the sensibility of the sensor is variable to a large extent depending on moving direction of the intruder with respect to installed position of the sensor, and that, in the sensor of the infrared detection system, a measure taken for detecting temperature difference between the intruder and ambient background is apt to fail in alarming the presence of the intruder in an event when the temperature difference disappears due to some factor, or to erroneously operate upon an abrupt change in the ambient temperature.

For the above reason, there has been further suggested a composite type crime preventive sensor in which a plurality of different detection type sensor units are employed for complementarily eliminating the above problems. In the known composite type crime preventive sensor, an erroneous alarming operation is prevented from occurring even when any one of the sensor units makes an error by obtaining a logical product of outputs from the respective sensor units, or an alarming output generation is made possible by any other sensor unit than the one which has failed the alarming by means of the logic sum of the outputs from the respective sensors. in the event of the logical product of the outputs, however, no conformity can be achieved in the watching pattern such as available detecting area or the like between the respective sensor units of the different types, so that there arises a problem that the entire watching pattern of the composite crime preventive sensor is rather deviated to a narrower one in the respective patterns of the sensor units, or that the possibility of the alarm failing is increased in respect of each of the sensor units depending on the moving direction of the intruder. In the case of the logic sum taken for the respective sensor unit outputs, on the other hand, an output generation at any one of the sensor units results in an alarm output generation so that the possibility of alarm failing can be remarkably reduced, but there still arises a problem that an erroneous operation at one of the sensor units which causes an alarm output generated may result in increased erroneous alarming.

Other composite type sensors employing, for example, two different type sensor units have been disclosed in U.S. Pat. No. 3,725,888 to E.E. Solomon, U.S. Pat. No. 4,401,976 to H. Stadelmayr, U.S. Pat. No. 4,660,024 to R. L. McMaster, and U.S. Pat. No. 4,710,750 to R.A. Johnson. However, the foregoing problems have been still left unsolved by these sensors.

TECHNICAL FIELD

A primary object of the present invention is, therefore, to provide a composite type crime preventive sensor which can effectively reduce any risk of the alarm failing due to the difference in the detection area or in the sensibility between the respective sensor units of different types, and also can minimize the possibility of erroneous alarming operation.

According to the present invention, this object can be attained by means of a composite type crime preventive sensor in which a plurality of sensor units of different detection systems are combined so that output detection signals from the respective sensor units are processed by a signal processing means so as to discriminate any intruder into a supervising zone, which sensor being featured in that the signal processing means comprises means for ranking the output detection signals from the respective sensor units into a plurality of grades depending on signal level, and means for providing as an output an intruder discrimination signal when a sum of ranked level values is above a preset reference value.

Other objects and advantages of the present invention shall be made clear by the following description of the invention detailed with reference to preferred embodiments shown in the accompanying drawings.

While the present invention shall now be explained with reference to the respective embodiments shown in the accompanying drawings, it should be appreciated that the intention is not to limit the invention only to these embodiments shown but to rather include all alterations, modifications and equivalent arrangements possible within the scope of appended claims.

DISCLOSURE OF PREFERRED EMBODIMENTS

Figure 1:
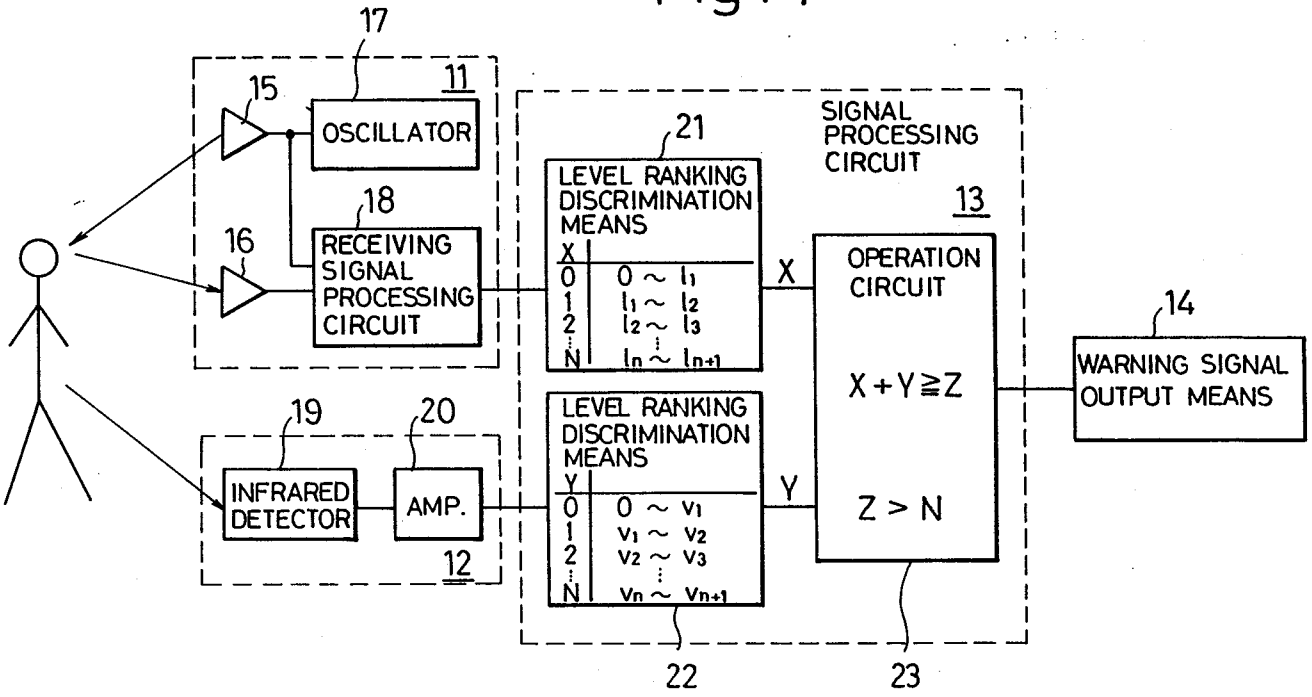
FIG. 1 is a block diagram showing in an embodiment the composite type crime preventive sensor according to the present invention.

Referring now to FIG. 1, there is shown an embodiment of the composite type crime preventive sensor according to the present invention, which comprises first and second sensor units 11 and 12 respectively of different detection systems, a signal processing circuit 13 receiving the detection signals from the both sensors 11 and 12 and executing a predetermined processing of the signals, and a warning signal output means 14 for generating a warning signal upon receipt of an output from the signal processing circuit 13. The first sensor unit 11 comprises, on one hand, a wave transmitter 15 which radiates an ultrasonic wave to a supervising zone, a wave receiver 16 receiving any incident reflection wave from an object in the zone of a continuous energy radiated from the transmitter 15 to the supervising zone, an oscillator 17 which continuously oscillates at a constant frequency to provide an output signal to the wave transmitter 15 for driving the same, and a received wave signal processing circuit 18 which receives from the wave receiver 16 a received wave signal together with the output signal from the oscillator 17. The second sensor unit 12 comprises, on the other hand, for example, an infrared detector 19 such as a pyroelectric element which converts temperature variation into an electric signal, and provides for detection of infrared of a wavelength of, for example, about 10 $\mu$m, and an amplifier 20 which receives an infrared detection signal from the detector 19.

Outputs from the received-wave signal processing circuit 18 of the first sensor unit 11 and from the amplifier 20 of the second sensor unit 12 are provided respectively to each of level ranking discrimination means 21 and 22, and discrimination outputs of these level ranking discrimination means 21 and 22, that is, level rank values X and Y, are provided to an operation circuit 23 which provides an output to a warning signal output means 14 when a sum of the level rank values X and Y exceeds a preset reference value Z. In first one of the level ranking discrimination means, that is, 21 in the present instance, levels of the output detection signal from the first sensor unit 11 are ranked from the lower level side from O through N and the level rank value X, that is, one of the ranked level values 0 through N is provided to the operation circuit 23, upon which the level rank value X is preferably set in accordance with moving distance in a single direction or moving time obtainable with respect to any intruder through a signal processing of the received-wave signal so that, in an event where a moving distance l is provided as an output of the detection signal, the value X can be set to be $l_1=10$ cm, $l_2=20$ cm, $l_3=30$ cm, . . . In the other level ranking discrimination means 22, too, the detection signal provided from the second sensor unit 12 is ranked from the lower level side from O through N, and the level rank value Y, that is, one of the values O through N is provided to the operation circuit 23, upon which the level rank value Y can be set to be, for example, $V_1=0.3$, $V_2=0.6$, $V_3=1.2$, . . .

In the operation circuit 23, more specifically, an operation is made to add the level rank values X and Y from the both level ranking discrimination means 21 and 22 to each other to determine whether or not their sum exceeds the preliminarily set reference value Z, that is, $X+Y \geqq Z$ is operated. The reference value Z is set, preferably, to be $Z>N$ ($Z>X_{max}$, $Z>Y_{max}$), so that no detection output will be provided to the warning signal output means 14 by an output of only one of the first and second sensor units.

Figure 2:
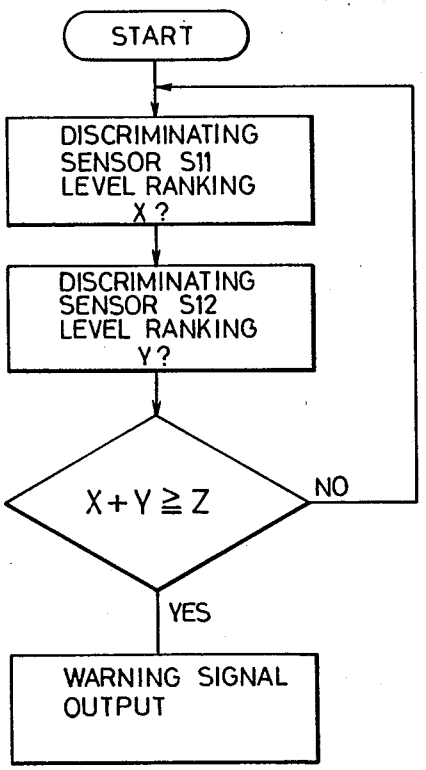
FIG. 2 is a flow chart denoting the operation of the sensor of FIG. 1.

Referring also to FIG. 2, the sensor of FIG. 1 is capable obtaining a high level detection signal at the first sensor unit 11 of the supersonic Doppler-effect system with respect to an intruder who is present in the supervising zone of the foregoing crime preventing sensor and wearing clothing which shields infrared, whereas the second sensor unit 12 of the infrared system can obtain only a low level detection signal. Provided that the setting is made with an assumption that $N=3$, it is possible to obtain the respective level rank values X and Y to be $X=3$ and $Y=1$. If the reference value Z is set to be 4, here, the added sum $X+Y$ of the both level rank values X and Y will be 4, that is, above the set reference value Z so that, even if the detection output from the second sensor unit 12 is low, the operation circuit 23 will provide a detection output to the warning signal output means 14 so as to actuate the same. In an event of a remarkable temperature change around the crime preventive sensor due to any disturbance, on the other hand, the second sensor unit 12 of the infrared detection system generates a high level detection signal which reaches the largest value of the level rank value $Y=3$, whereas the first sensor unit 11 of the ultrasonic Doppler-effect system provides no output so that the level rank value X will be $X=0$ and thus the sum $X+Y$ will be 3 which does not reach the reference value Z, whereby the operation circuit 23 is caused not to generate any detection output with respect to the intruder.

It should be appreciated here that, in the composite type crime preventive sensor according to the present invention of the foregoing arrangement, the risk of the alarm failing or of erroneous alarming can be remarkably reduced.

Figure 3:
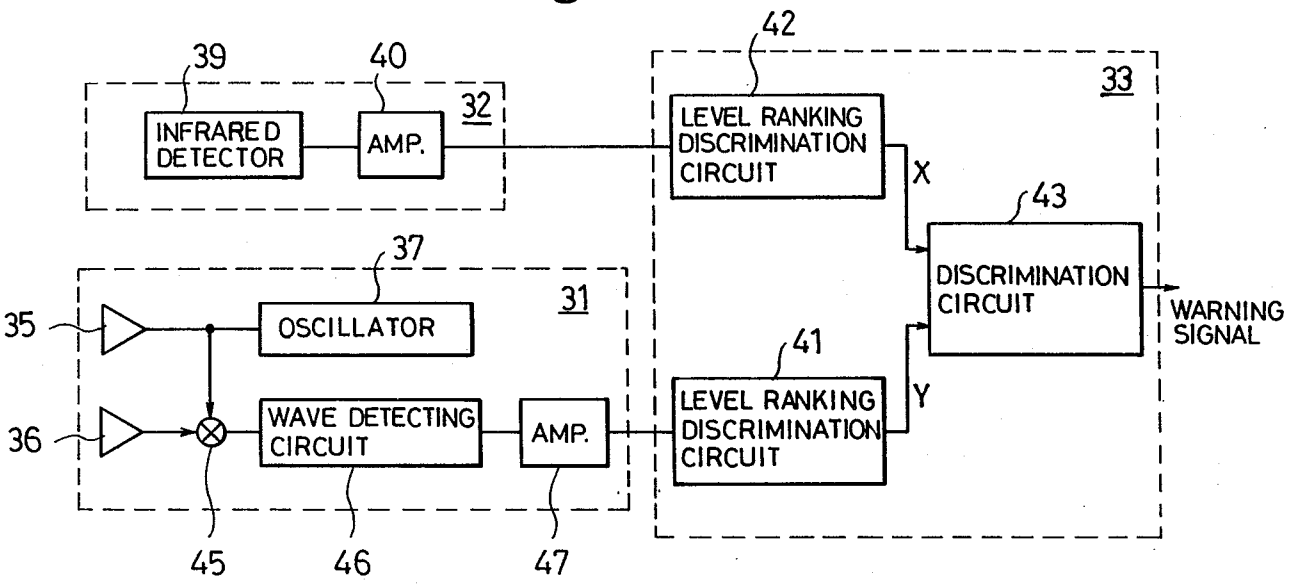
FIG. 3 is a block diagram showing another embodiment of the composite type crime preventive sensor according to the present invention.

In FIG. 3, there is shown another embodiment of the composite type crime preventive sensor according to the present invention. achieves substantially the same operation as in the FIG. 1 embodiment. In the present embodiment, however, the arrangement is so made that, in the level ranking discrimination circuits 41 and 42, the largest level rank value can be retained for a fixed time. More specifically, the detection outputs of the first and second sensor units 31 and 32 can be obtained as a voltage responsive to the movement of the intruder or the intensity of infrared emitted from the intruder, as shown more concretely in FIG. 4. In the present instance, for example the detection signal level is divided into three stage level ranks of 0, 1 and 2 by means of two threshold values $Vth_1$ and $Vth_2$. When the detection signal level exceeds a first one, $Vth_1$, of these threshold values, for example, at a time a in FIG. 4 but such excess level does not continue to remain above the threshold value for a period of a fixed time interval $\tau_0$, the level rank is kept remain to be "0". When the detection signal level exceeds and continues to be above the first threshold value $Vth_1$ for the fixed time interval $\tau_0$ at a time b in FIG. 4, the level rank is made "1" and, further when the detection signal level exceeds and continues to be above the second threshold value $Vth_2$ for the fixed time interval $\tau_0$ at a time c, the level rank is then made to be "2". In the case when the detection signal level decreases to be below the second threshold value $Vth_2$ at a time d, on the other hand, the level rank is to be maintained at "2" until a time e when a fixed time period $T_1$ elapses from the time d, irrespective of the decrease in the signal level. Upon elapsing of this time interval $T_1$, the level rank discrimination is carried out in accordance with the detection signal level as has been disclosed, and the level rank is made "0" since, in the embodiment shown here, the detection signal level is below the first threshold level $Vth_1$ at the time e.

Figure 4:
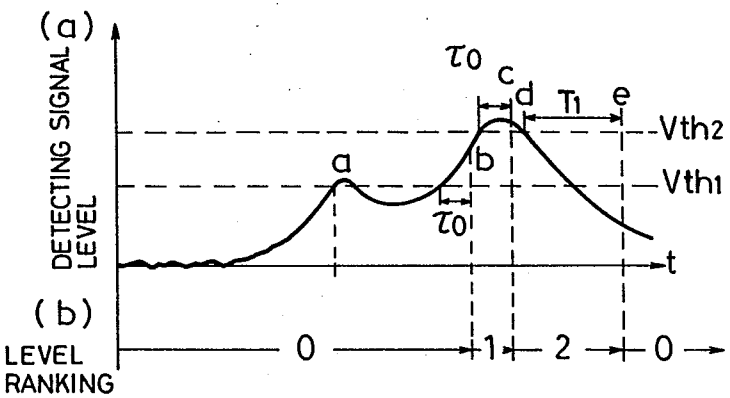
FIG. 4 is a diagram showing the relationship between a detection signal and its level ranking in the sensor of FIG. 3.

According to the embodiment of FIGS. 3 and 4, the operation of $X+Y \geqq Z$ in the operation circuit 43 can be carried out more accurately so as to additionally reduce the risk of the alarm failing, since the level rank "2", that is, the largest level rank value is to be kept maintained for the fixed time interval $T_1$ after the time when the detection signal level has reached the largest value, even when the first and second sensor units 31 and 32 involve a difference in their sensibility and also in the timing when their detection signal levels reach the largest value.

In the embodiment of FIG. 3, the received wave signal processing circuit in the foregoing embodiment of FIG. 1 is shown more concretely in a practical working aspect, and the circuit comprises a mixer 45, wave detecting circuit 46 and amplifier 47. In this case, the mixer 45 receives an output of the wave receiver 36 and also an output of the oscillator 37 directly therefrom, and provides to the wave detecting circuit 46 a frequency difference between the transmitted ultrasonic wave and the reflected ultrasonic wave. In the detecting circuit 46, an output responsive to the movement of the intruder can be obtained, and this output is to be provided through the amplifier 47 to the first level ranking discrimination circuit 41 corresponding to the first sensor unit 31.

Figure 5:
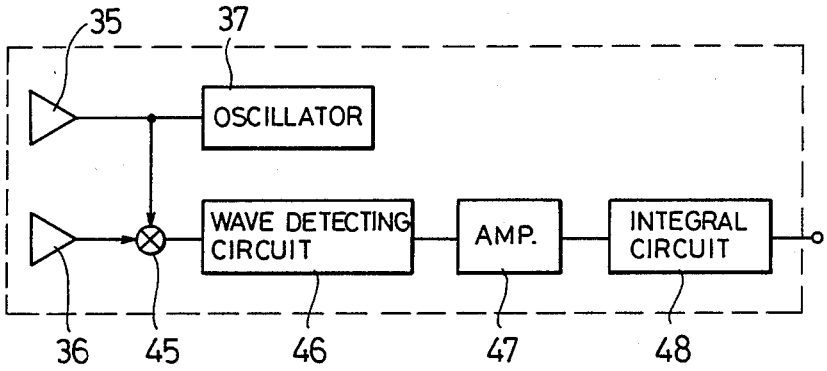
FIG. 5 shows in a block diagram still another embodiment of the composite type crime preventive sensor according to the present invention.

In the received wave signal processing circuit, it is possible to further include an integral circuit 48 connected to a latter stage of the amplifier 47 as shown in FIG. 5. With this integral circuit 48, the output from the wave receiver 36 is integrated and then provided to one of the first and second level rank discrimination circuits where, as will be clear from FIG. 6, a threshold value $Vth_3$ is set and the integrated output can be divided into three level ranks of 0, 1 and 2 only by means of this threshold value $Vth_3$. In an event where an output of the integral circuit 48 has reached the threshold value $Vth_3$ within a predetermined time period $T_2$ as seen at times f and g in FIG. 6, the level rank is raised one by one, while the level rank is to be lowered one by one when the output of the integrating circuit 48 does not exceed the threshold value within the predetermined time period $T_2$. Upon occurrence of the level rank raise and lowering, the integrated output is initialized. The arrangement of FIGS. 5 and 6 is also so made that the level rank "2" will be kept maintained for the time period $T_2$ once the largest value of the level rank is reached, and the risk of the alarm failing can be sufficiently reduced.

Figure 6:
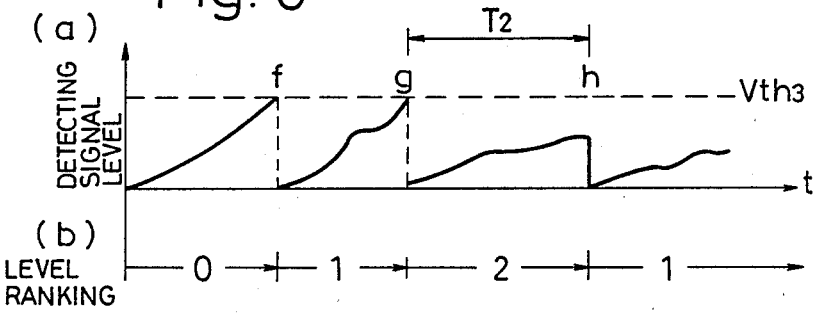
FIG. 6 is a diagram showing the relationship between a detection signal and its level ranking in the sensor of FIG. 5.

In the embodiment of FIGS. 5 and 6, other than as previously described the arrangement and operation are the same as those in the case of FIGS. 3 and 4.

Figure 8:
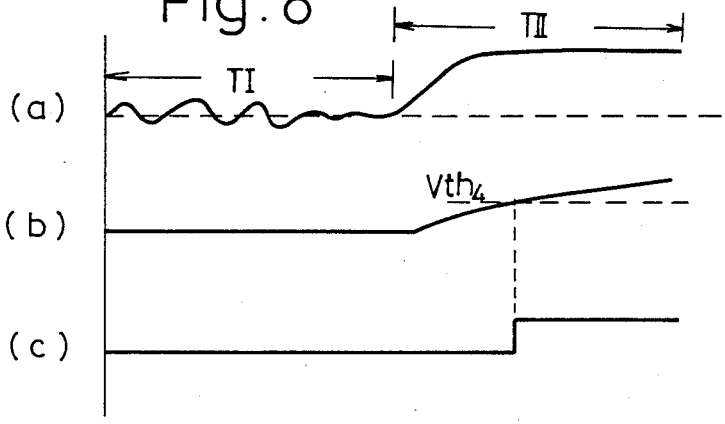
FIG. 8 is a diagram for explaining the operation of the sensor of FIG. 7.
Figure 7:
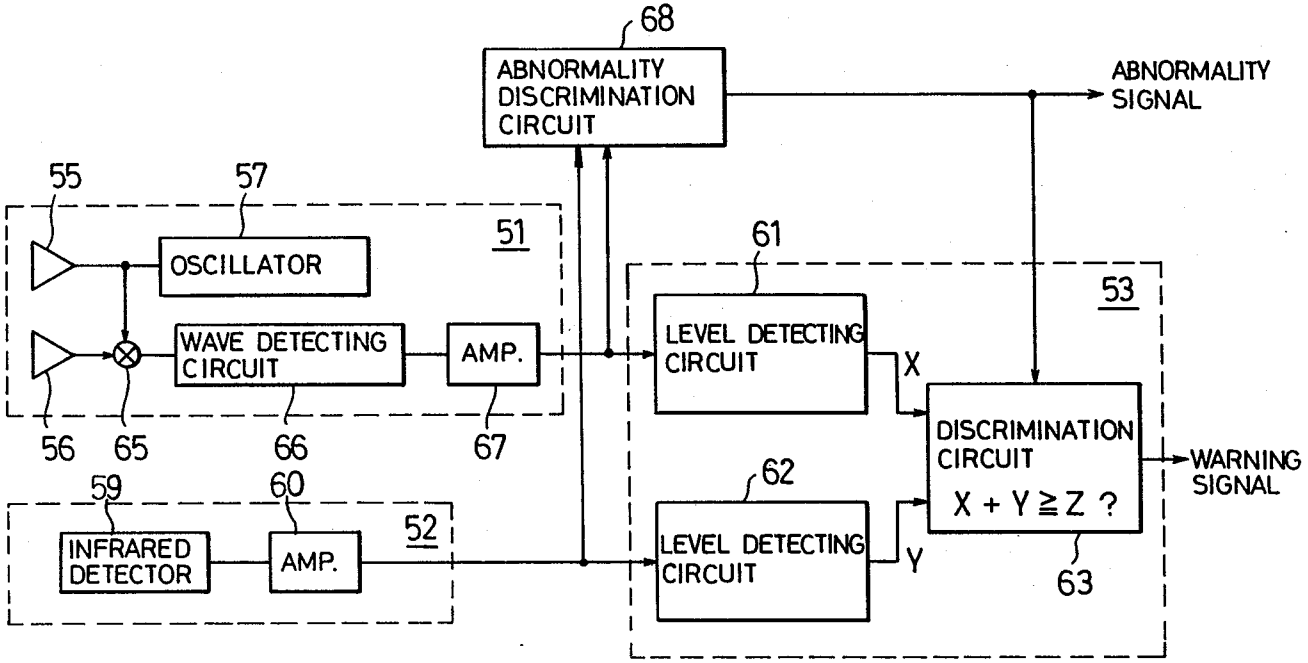
FIG. 7 is a block diagram showing a further embodiment of the composite type crime preventive sensor according to the present invention.

Referring next to FIG. 7, still another embodiment of the present invention is shown, and the arrangement and operation are also the same as in FIG. 3. In the present embodiment of FIG. 7, however, there is provided an abnormality discrimination circuit 68 additionally to the arrangement of FIG. 3. The risk of alarm failing can be restrained by means of the abnormality discrimination circuit 68 upon such abnormality occurrence as a fault of the first and second sensor units 51 and 52. For example a detection signal such as in FIG. 8(*a*) is obtained at the first sensor unit 51, and the integrated values of this signal are limited to be within a certain range for a time period TI. However, if a circuit fault such as a disconnection occurs in the first sensor unit 51, the value is caused to deviate continuously so as to be fixed as deviated from a reference value shown by dotted line in FIG. 8(*a*) for a next time period TII, and the integrated value then loses its balance as shown in FIG. 8(b). At the time when the integrated value exceeds a threshold value $Vth_4$, the abnormality discrimination circuit 68 provides an output such as shown in FIG. 8(*c*) to the level ranking discrimination circuit 63. In this case, the reference value Z is set to be below the largest value N of the level rank so that, even when the detection output of the first sensor unit 51 is at zero level but the other second sensor unit 52 is providing a detection output of a value denoting the presence of an intruder within the supervised zone, a driving output will be provided to the warning output means.

In the embodiment of FIG. 7, further, the arrangement may be so made as to have an abnormality signal generated by the abnormality discrimination circuit 68 and to have an alarming thereby carried out through a proper alarming means (not shown).

In the present invention, the foregoing arrangement may be freely modified in the design. For example, while the first sensor unit is of the ultrasonic Doppler-effect system and the second sensor unit is of the infrared detection system, any other sensor unit such as a microwave Doppler-effect system, a system for detecting an intruder movement by means of a pair of vector signals in accordance with frequency deviation or the like may be employed. Further, while the embodiment of FIG. 7 has been so set forth as to connect the abnormality discrimination circuit 68 to the first and second sensor units, the circuit 68 may be connected only to either one of these two sensor units which is known to have a higher probability of causing the fault, so as to simplify the arrangement.

What is claimed is:

1. A composite type crime preventive sensor comprising: a plurality of sensor units respectively of different detecting systems and employed in combination with one another, means for processing output detecting signals from said sensor units, said means for processing output detection signals including means for correlating each of said output detection signals from the respective sensor units with a corresponding one of a plurality of grades depending on signal level to provide a ranked level value for each of said output detection signals, and means for providing as an output an intruder discrimination signal when a sum of the ranked level values is above a preset reference value, wherein said preset reference value is set to be larger than the largest ranked level of said ranked level values.

2. A composite type crime preventing sensor according to claim 1, wherein said preset reference value is set to be larger than the largest ranked level value of said ranked level values.

3. A composite type crime preventive sensor comprising: a plurality of sensor units respectively of different detecting systems and employed in combination with one another, means for processing output detection signals from said sensor units, said means for processing output detection signals including means for correlating each of said output detection signals from the respective sensor units with a corresponding one of a plurality of grades depending on signal level to provide a ranked level value for each of said output detection signals, and means for providing as an output an intruder discrimination signal when a sum of the ranked level values is above a preset reference value, wherein for at least one of said plurality of sensor units the largest ranked level value of said ranked level values when achieved is maintained for a fixed period.

4. A composite type crime preventive sensor comprising: a plurality of sensor units respectively of different detecting systems and employed in combination with one another, means for processing output detection signals from said sensor units, said means for processing output detection signals including means for correlating each of said output detection signals from the respective sensor units with a corresponding one of a plurality of grades depending on signal level to provide a ranked level value for each of said output detection signals, and means for providing as an output an intruder discrimination signal when a sum of the ranked level values is above a preset reference value, wherein said means for correlating each of said output detection signals has a plurality of threshold values to be used for the output detection signal level ranking, and the ranked level value being assigned to an output detection signal corresponds to one of said plurality of threshold values which the output detection signal exceeds for a predetermined time period.

5. A composite type crime preventive sensor according to claim 4, wherein for at least one of said plurality of sensor units the largest ranked level value of said ranked level values when achieved is maintained for a fixed time period.

6. A composite type crime preventive sensor comprising: a plurality of sensor units respectively of different detecting systems and employed in combination with one another, means for processing output detection signals from said sensor units, said means for processing output detection signals including means for correlating each of said output detection signals from the respective sensor units with a corresponding one of a plurality of grades depending on signal level to provide a ranked level value for each of said output detection signals, and means for providing as an output an intruder discrimination signal when a sum of the ranked level values is above a preset reference value, wherein said means for correlating each of said output detection signals has at least a threshold value for the detection signal level ranking, the ranked level value being raised by one grade when the signal level exceeds the threshold value within a predetermined time period but lowered by one grade when the signal level does not exceed the threshold value within the predetermined time period.

7. A composite type crime preventive sensor comprising: a plurality of sensor units respectively of different detecting systems and employed in combination with one another, means for processing output detection signals from said sensor units, said means for processing output detection signals including means for correlating each of said output detection signals from the respective sensor units with a corresponding one of a plurality of grades depending on signal level to provide a ranked level value for each of said output detection signals, means for providing as an output an intruder discrimination signal when a sum of the ranked level values is above a preset reference value, and an abnormality discrimination means connected to at least one of said plurality of sensor units for selectively allowing a determination of whether said intruder discrimination signal is to be output on the basis of the output detection signal of each sensor unit other than the output detection signal of at least one of the sensor units, with said preset reference value set to be below the largest ranked level value of said ranked level values.

* * * * *